US007259516B2

(12) United States Patent
Wan et al.

(10) Patent No.: US 7,259,516 B2
(45) Date of Patent: Aug. 21, 2007

(54) ALIGNMENT STRUCTURE FOR PLASMA DISPLAY PANEL

(75) Inventors: Hsiang-Wen Wan, Sanchong (TW); Yao-Ching Su, Taoyuan (TW)

(73) Assignee: Au Optronics Corp., Hsinchu (TW)

( * ) Notice: Subject to any disclaimer, the term of this patent is extended or adjusted under 35 U.S.C. 154(b) by 429 days.

(21) Appl. No.: 10/842,117

(22) Filed: May 10, 2004

(65) Prior Publication Data

US 2005/0221713 A1 Oct. 6, 2005

(30) Foreign Application Priority Data

Mar. 30, 2004 (TW) ..... 93108641 A

(51) Int. Cl.
*H01J 17/49* (2006.01)

(52) U.S. Cl. ..... 313/582; 313/292; 313/586; 313/587; 445/24

(58) Field of Classification Search ..... 349/187–192; 445/24, 25; 313/582–587
See application file for complete search history.

(56) References Cited

U.S. PATENT DOCUMENTS 7,029,357 B2 * 4/2006 Ikeya et al. ..... 445/24
2005/0151473 A1 * 7/2005 Wan et al. ..... 313/582

FOREIGN PATENT DOCUMENTS

| | | | |
|---|---|---|---|
| JP | 06267435 A | * | 9/1994 |
| JP | 08006005 A | * | 1/1996 |
| JP | 08062597 A | * | 3/1996 |
| JP | 08254692 A | * | 10/1996 |
| JP | 10162727 A | * | 6/1998 |
| JP | 2002367523 A | * | 12/2002 |
| JP | 2003092064 | | 3/2003 |
| JP | 2003132806 | | 5/2003 |
| JP | 2004119217 | | 4/2004 |
| KR | 2004107063 A | * | 12/2004 |

OTHER PUBLICATIONS

China Office Action mailed May 19, 2006.

* cited by examiner

*Primary Examiner*—Mariceli Santiago
(74) *Attorney, Agent, or Firm*—Thomas, Kayden, Horstemeyer & Risley

(57) ABSTRACT

A plasma display panel (PDP) with alignment structure. A first alignment pattern is disposed on a rear substrate and formed by a rib structure. A second alignment pattern is disposed on a front substrate disposed opposite, over the rear substrate and corresponds to a space defined by the first alignment pattern. The first and second alignment patterns are disposed outside of the display area of the plasma display panel.

28 Claims, 11 Drawing Sheets

ALIGNMENT STRUCTURE FOR PLASMA DISPLAY PANEL

BACKGROUND OF THE INVENTION

1. Field of the Invention

The present invention relates in general to a plasma display panel (PDP), and more particularly, to an alignment structure for assembling a plasma display panel.

2. Description of the Related Art

Recently, a variety of flat panel displays, such as liquid crystal display (LCD) and plasma display panel (PDP) have been intensively developed to replace cathode ray tube (CRT) displays. In PDP technology, ultraviolet light is emitted to excite RBG phosphors and produce visible light. The advantages of the PDP include a large display area, wide viewing angle, and intense brightness.

FIG. 11 illustrates a conventional plasma display panel structure. The PDP comprises a rear glass substrate 300 and a front glass substrate 308 spaced apart from each other. A plurality of address electrodes (data electrodes) 302 is disposed on the rear substrate 300 and faces the front substrate 308. A dielectric layer 304 is provided overlying the rear substrate 300 to cover the address electrodes 302. Moreover, a plurality of rectangular or hexagonal rib structures 306 adjacent to each other is disposed on the dielectric layer 304 to define discharge cells. Phosphors (not shown) having three primary colors (R, G, and B) are alternately coated on the discharge cells defined by the rib structures 306. A plurality of pairs of display electrodes (scan electrodes) 310 is disposed on the front substrate 308 and faces the rear substrate 300. Each pair of display electrodes 310 comprises a transparent electrode 310*a* and a bus electrode 310*b*. A dielectric layer 312 and an MgO protective layer 314 are successively provided on the display electrodes 310. An inert gas, such as argon, is injected into the discharge cells after the rear and front substrates 300 and 308 are sealed.

For luminance efficiency and quality assurance, it is necessary that the display electrodes on the front substrate be accurately aligned with the discharge cells defined by the rib structures on the rear substrate. In general, alignment marks with a circular or cross shape are additionally formed on the front and rear substrates, respectively. However, an alignment mark with a circular or cross shape on the rear substrate is formed when the address electrode is formed. The alignment mark must undergo several thermal processes for the fabrication of dielectric layer and rib structures. As a result, the alignment mark deforms or shifts from the original position, significantly increasing alignment errors.

SUMMARY OF THE INVENTION

Accordingly, an object of the present invention is to provide a novel alignment structure for a plasma display panel (PDP) to reduce alignment errors between the rear and front substrates of the PDP.

Another object of the present invention is to provide a novel alignment structure for a plasma display panel, which employs at least one rib structure or address electrode on the rear substrate and positioned outside of the display area as an alignment pattern, thereby reducing alignment errors between the rear and front substrates of the PDP.

The above and other objects and advantages, which will be apparent to one skilled in the art, are achieved in the present invention which is directed to, in a first aspect, an alignment structure for a plasma display panel. The alignment structure includes a first alignment pattern and a second alignment pattern. The first alignment pattern is disposed on a rear substrate and formed by a rib structure. The second alignment pattern is disposed on a front substrate disposed opposite, over the rear substrate, and corresponding to a space defined by the first alignment pattern. Moreover, the first and second alignment patterns are outside of a display area of the PDP.

In another aspect of the invention, an alignment structure for a plasma display panel is provided. The alignment structure includes a first alignment pattern and a rectangular and ringed second alignment pattern. The first alignment pattern is disposed on a rear substrate and formed by an address electrode having a rectangular block. The rectangular and ringed second alignment pattern is disposed on a front substrate disposed opposite, over the rear substrate, and corresponding to a space around the rectangular block. Moreover, the first and second alignment patterns are outside of a display area of the PDP.

In yet another aspect of the invention, an alignment structure for a plasma display panel is provided. The alignment structure includes a columnar first alignment pattern and a disklike second alignment pattern. The columnar first alignment pattern is disposed on a rear substrate and formed by a rib. The disklike second alignment pattern is disposed on a front substrate disposed opposite, over the rear substrate, and corresponding to the columnar first alignment pattern. Moreover, the first and second alignment patterns are outside of a display area of the PDP.

In yet another aspect of the invention, an alignment structure for a plasma display panel is provided. The alignment structure includes a first alignment pattern and a second alignment pattern. The first alignment pattern is disposed on a rear substrate and formed by a rib structure. The second alignment pattern is disposed on a front substrate disposed opposite, over the rear substrate, extending from the end of a bus electrode and corresponding to a space defined by the first alignment pattern. Moreover, the first and second alignment patterns are outside of a display area of the PDP.

DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
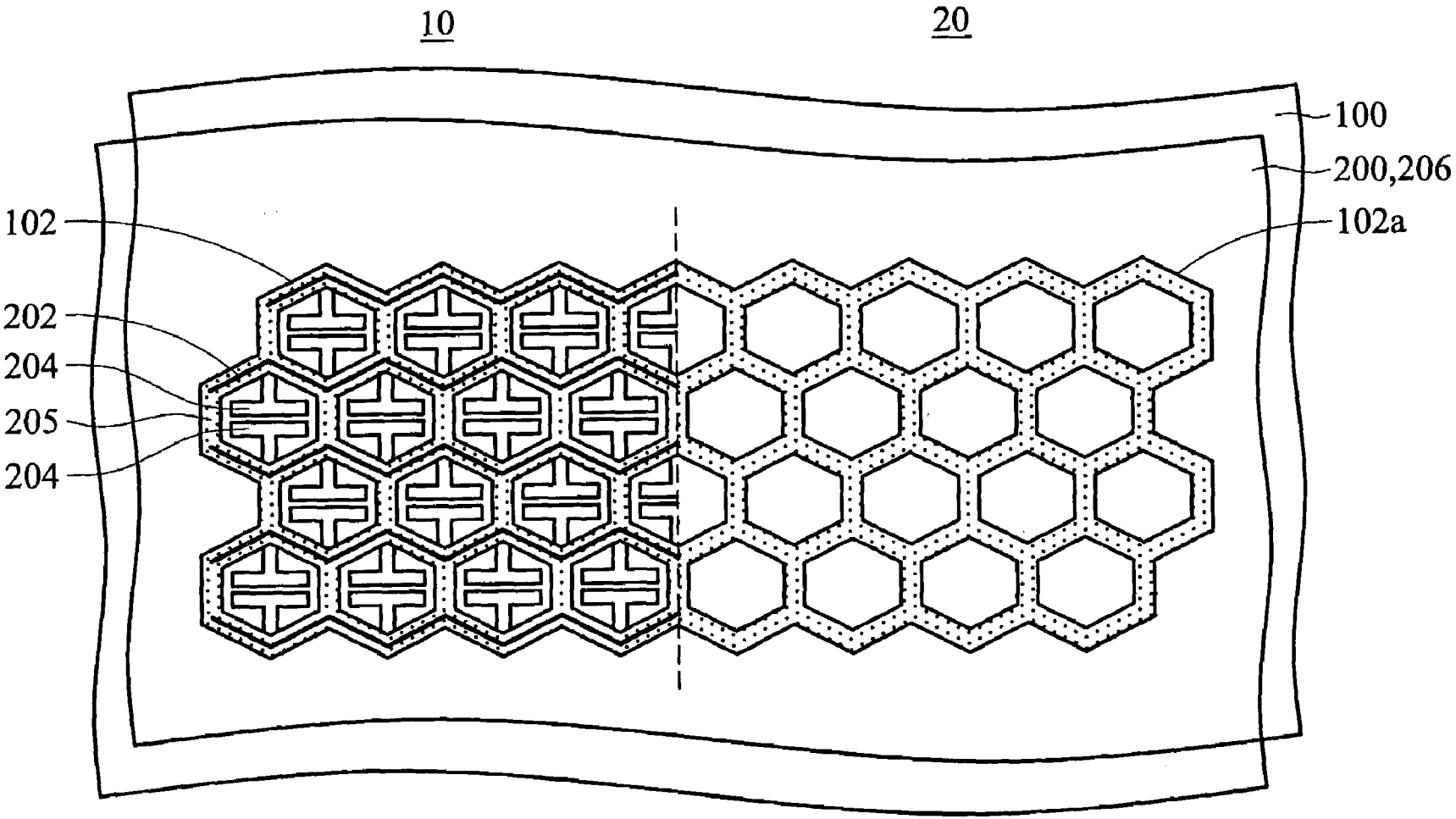
FIG. 1 is a plane view of an alignment relationship between front and rear substrates of a plasma display panel according to the invention.

In FIG.1, the plasma display panel (PDP) comprises a rear substrate 100 and a front substrate 200 opposite to each other. The rear substrate 100 and the front substrate 200 are divided into a display area 10 and a non-display area 20.

Hexagonal rib structures 102 and 102*a* are respectively formed on the display area 10 and the non-display area 20 of the rear substrate 100, with each hexagonal rib structure adjacent to constitute a honeycombed rib structure, as shown in FIG. 1. It is noted that the hexagonal rib structures 102 and 102*a* may be enclosed or have openings at corners for injecting and exhausting gas. The spaces defined by the hexagonal rib structures 102 on the display area 10 act as discharge cells. A plurality of address electrodes (not shown) parallel to each other is disposed on the rear substrate 100 under the hexagonal rib structures 102 and 102*a*.

A plurality of bus electrodes 202, such as Cr—Cu alloy, overlies the front substrate 200 and corresponds to the shape of the hexagonal rib structures 102 with a saw-toothed profile. Moreover, a plurality of T-shaped transparent electrodes 204 also overlies the front substrate 200 and corresponds to spaces defined by the hexagonal rib structures 102. Here, two T-shaped transparent electrodes 204 are symmetrically arranged in the space defined by the hexagonal rib structures 102 and electrically connected to the tip portion of the electrodes 202 with the saw-toothed profile. The transparent electrodes 204 may comprise indium tin oxide (ITO). Additionally, a black matrix 205 overlies the bus electrodes lines 202 and corresponds to the honeycombed structure formed on the rear substrate 100. A dielectric layer 206 and a protective layer (not shown), such as an MgO layer, successively overlie the front substrate 200 to cover the black matrix 205, the bus electrodes 202, and the transparent electrodes 204.

It is note that the rib structures 102 and 102*a* shown in FIG. 1 have a hexagonal shape. However, the invention is not limited to this. For example, the rib structure 102 and 102*a* may have a quadrangular, pentagonal, or cross shape.

In order for the transparent electrodes 204 and bus electrodes 202 formed on the front substrate 200 to accurately correspond to the discharge cells and the hexagonal rib structures 102, respectively, an alignment structure is required. Accordingly, in the invention, an alignment structure is provided in the non-display area 20 between the rear and front substrates 100 and 200. FIGS. 2 to 10 illustrate several examples of the alignment structure formed on the non-display area 20 of the plasma display panel according to the invention.

Figure 2:
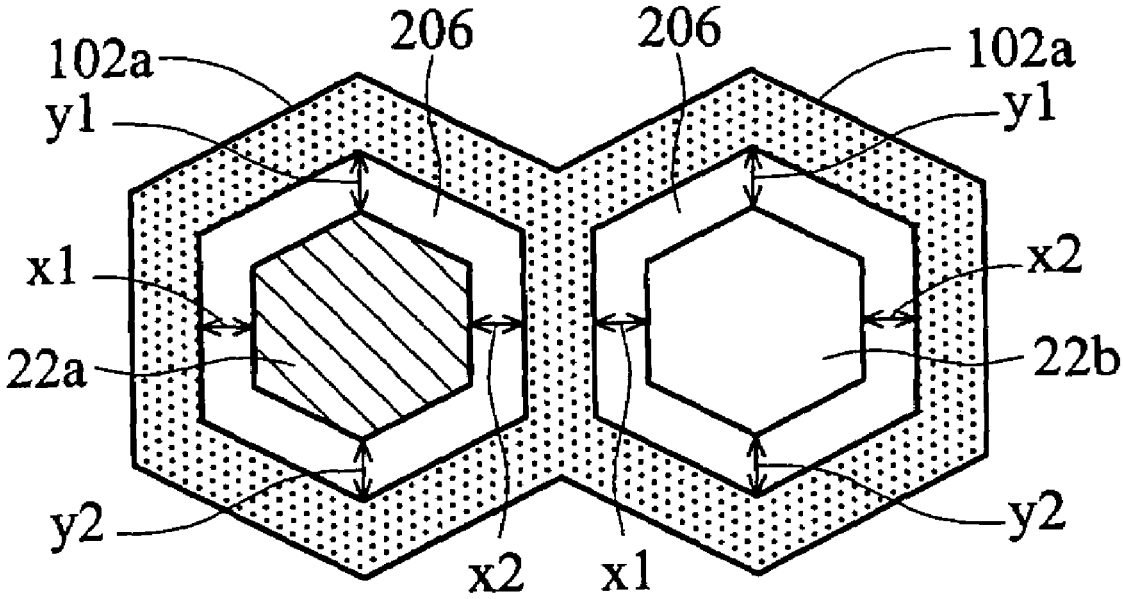
FIG. 2 is a plane view of an example of an alignment structure for a plasma display panel according to the invention.

FIG. 2 is a plane view of an example of an alignment structure for a plasma display panel according to the invention. Referring to FIGS. 1 and 2, the alignment structure includes a rear substrate 100, a first alignment pattern 102*a*, a front substrate 200, and a second alignment pattern 22*a*. In the invention, one alignment pattern is disposed on the rear substrate 100 outside of the display area 10 and formed by at least one hexagonal rib structure. That is, at least one of the hexagonal rib structures 102*a* disposed on the non-display area 20 may act as the first alignment pattern.

The second alignment pattern 22*a* is disposed on the front substrate 200 disposed opposite, over the rear substrate 100. In the invention, the second alignment pattern 22*a* corresponds to a space defined by the first alignment pattern 102*a*. Moreover, the second alignment pattern 22*a* has a profile (or shape) similar to that of the rib structure 102*a*. That is, the second alignment pattern 22*a* has a hexagonal profile. Moreover, the second alignment pattern 22*a* is separated therefrom by predetermined distances x1, x2, y1, and y2. The second alignment pattern 22*a* with a hexagonal profile similar to the hexagonal rib structure 102*a* may be formed when the plurality of bus electrodes 202 is formed overlying the front substrate 200. Moreover, the second alignment pattern 22*a* may be formed when the plurality of transparent electrodes 204 or the black matrix 205 is formed overlying the front substrate 200.

When alignment is performed between the front and rear substrates 200 and 100, facing alignment can be used by the angles of the first alignment pattern 102*a* to the angles of the second alignment pattern 22*a*. Additionally, the predetermined distances x1, x2, y1, and y2 may be measured for perpendicular and horizontal alignment and for alignment interstitial control.

Additionally, the dielectric layer 206 overlying the front substrate 200 can be etched to form an opening 22*b* to serve as the second alignment pattern. The second alignment pattern 22*b* has a hexagonal profile similar to the hexagonal rib structure 102*a* and is separated from the hexagonal rib structure 102*a* by predetermined distances x1, x2, y1, and y2. Also, the method mentioned can be used to align the front and rear substrates 200 and 100.

Figure 3A:
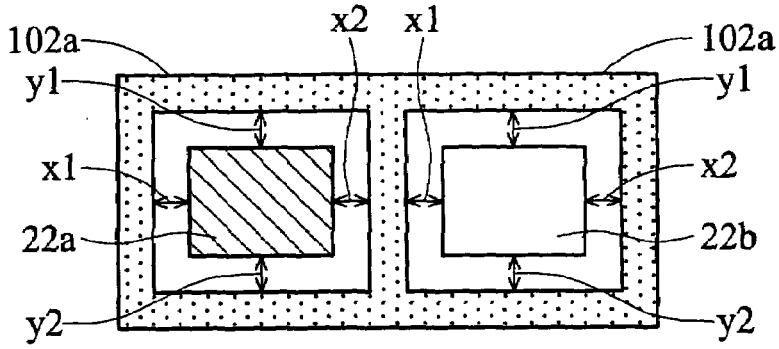
FIG. 3*a* illustrates the rib structure with quadrangular shape of the invention.
Figure 3B:
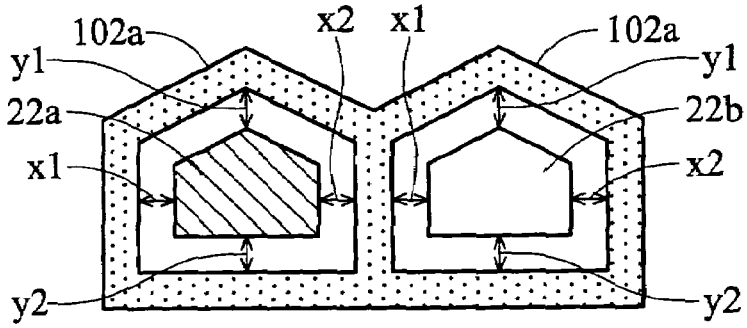
FIG. 3*b* illustrates the rib structure with pentagonal shape of the invention.
Figure 3C:
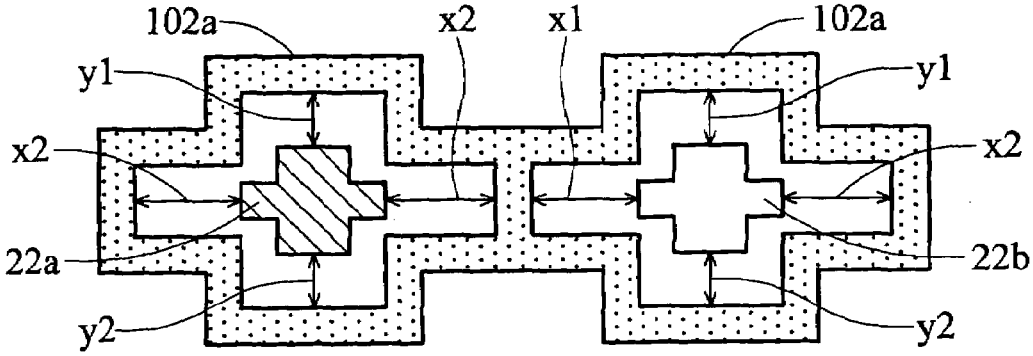
FIG. 3*c* illustrates the rib structure with cross shape of the invention.

In FIG. 2, the first alignment pattern 102*a* has a hexagonal shape. However, the invention is not limited to this. For example, the first alignment pattern 102*a* may have a quadrangular, pentagonal, or cross shape. FIGS. 3*a* to 3*c* illustrate varied rib structures of the invention. Like elements in FIG. 2 and FIGS. 3*a* to 3*c* are denoted by like numbers and the description of the same or like parts is omitted. In FIG. 3*a*, the first alignment pattern 102*a* has a quadrangular shape and the second alignment pattern 22*a* or 22*b* also has a quadrangular shape similar to the first alignment pattern 102*a*. In FIG. 3*b*, the first alignment pattern 102*a* has a pentagonal shape and the second alignment pattern 22*a* or 22*b* also has a pentagonal shape similar to the first alignment pattern 102*a*. In FIG. 3*c*, the first alignment pattern 102*a* has a cross shape and the second alignment pattern 22*a* or 22*b* also has a cross shape similar to the first alignment pattern 102*a*.

Figure 4:
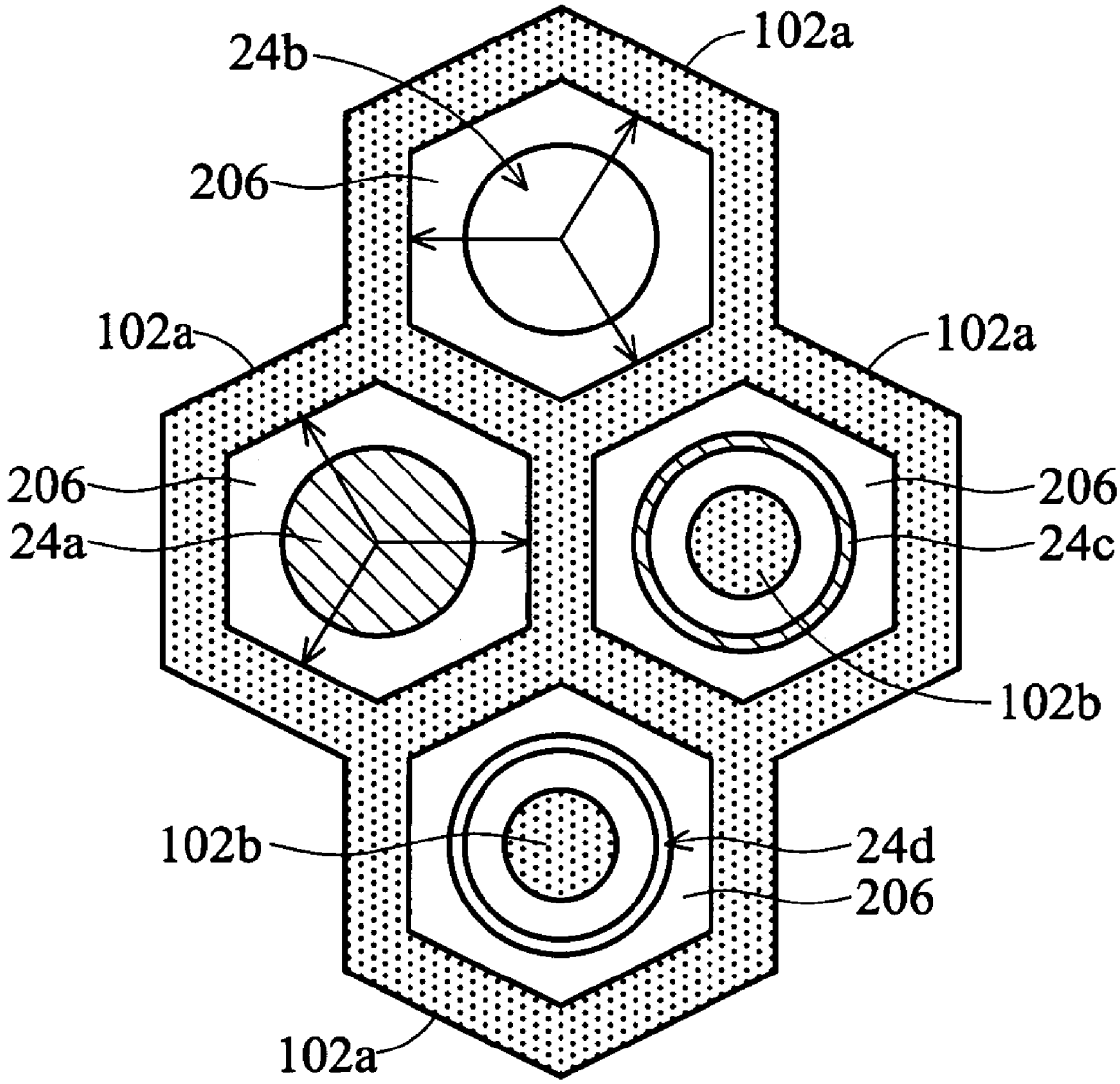
FIG. 4 is a plane view of another example of an alignment structure for a plasma display panel according to the invention.

FIG. 4 is a plane view of another example of an alignment structure for a plasma display panel according to the invention. Referring to FIGS. 1 and 4, the alignment structure includes a rear substrate 100, a first alignment pattern 102*a*, a front substrate 200, and a second alignment pattern 24*a*. In the invention, one alignment pattern is disposed on the rear substrate 100 outside of the display area 10 and formed by at least one hexagonal rib structure. That is, at least one of the hexagonal rib structures 102*a* on the non-display area 20 may be used as the first alignment pattern.

The second alignment pattern 24*a* is disposed on the front substrate 200 disposed opposite, over the rear substrate 100. In the invention, the second alignment pattern 24*a* corresponds to a space defined by the first alignment pattern 102*a*. Moreover, the second alignment pattern 24*a* has a circular profile and is separated therefrom. The second alignment pattern 24*a* with a circular profile may be formed when the plurality of bus electrodes lines 202 is formed on the front substrate 200. Moreover, the second alignment pattern 24*a* may be formed when the plurality of transparent electrodes 204 or the black matrix 205 is formed on the front substrate 200.

When alignment is performed between the front and rear substrates 200 and 100, the distance from the center of the second alignment pattern 24*a* to the edges of the first alignment pattern (hexagonal rib structure) 102*a* can be measured for alignment interstitial control.

Additionally, the dielectric layer 206 overlying the front substrate 200 can be etched to form a circular opening 24*b* to serve as the second alignment pattern. The second alignment pattern 24*b* is separated from the first alignment pattern 102*a* and the method mentioned can be used to align the front and rear substrates 200 and 100.

Moreover, in the invention, a circular and ringed pattern 24*c* can be used as the second alignment pattern and may be formed when the plurality of bus electrodes 202 or the plurality of transparent electrodes 204 or the black matrix 205 is formed overlying the front substrate 200. Also, a circular and ringed opening 24*d* formed by etching the dielectric layer 206 overlying the front substrate 200 can be used as the second alignment pattern. Moreover, an additional columnar rib 102*b* can be optionally disposed on the rear substrate 100 corresponding to a space defined by the ringed second alignment pattern 24*c* or 24*d*. In general, the columnar rib 102*b* is an alignment mark for phosphor alignment, and is formed when the honeycombed rib structure is formed.

The concentric circle method can be used by the columnar rib 102*b* and the ringed second alignment pattern 24*c* or 24*d* for alignment of the front and rear substrates 200 and 100.

In FIG. 4, the first alignment pattern 102*a* has a hexagonal shape. However, the invention is not limited to this. For example, the first alignment pattern 102*a* may have a quadrangular shape, as shown in FIG. 3*a*. Moreover, the first alignment pattern 102*a* may have a pentagonal shape, as shown in FIG. 3*b*. Furthermore, the first alignment pattern 102*a* may have a cross shape, as shown in FIG. 3*c*.

Figure 5:
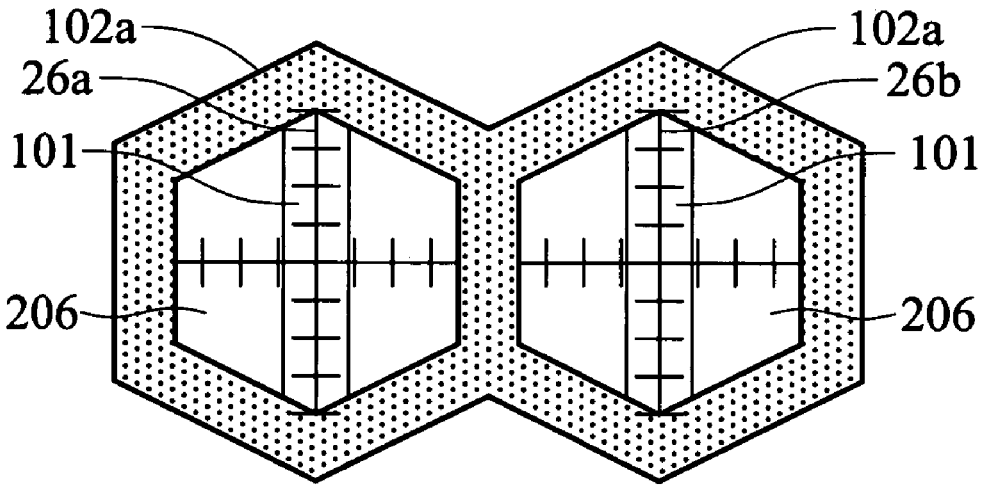
FIG. 5 is a plane view of yet another example of an alignment structure for a plasma display panel according to the invention.

FIG. 5 is a plane view of yet another example of an alignment structure for a plasma display panel according to the invention. Referring to FIGS. 1 and 5, the alignment structure includes a rear substrate 100, a first alignment pattern 102*a*, a front substrate 200, and a yardstick second alignment pattern 26*a*. In the invention, one alignment pattern is disposed on the rear substrate 100 outside of the display area 10 and formed by at least one hexagonal rib structure. That is, at least one of the hexagonal rib structures 102*a* on the non-display area 20 may be used as the first alignment pattern.

The yardstick second alignment pattern 26*a* is disposed on the front substrate 200 disposed opposite, over the rear substrate 100. In the invention, the yardstick second alignment pattern 26*a* corresponds to a space defined by the first alignment pattern 102*a*. Moreover, the yardstick second alignment pattern 26*a* may be formed when the plurality of bus electrodes lines 202 is formed overlying the front substrate 200. Moreover, the yardstick second alignment pattern 26*a* may be formed when the plurality of transparent electrodes 204 or the black matrix 205 is formed overlying the front substrate 200.

When alignment is performed between the front and rear substrates 200 and 100, the yardstick pattern 26*a* can be used to adjust the position of the front substrates 200 or the rear substrates 100.

Additionally, the dielectric layer 206 overlying the front substrate 200 can be etched to form a yardstick opening 22*b* to serve as the second alignment pattern. Also, the method mentioned can be used for aligning the front and rear substrates 200 and 100.

Additionally, in the invention, a third alignment pattern 101 may correspond to the space defined by the first alignment pattern 102*a*. For example, the third alignment pattern 101 may be formed by a dummy address electrode disposed between the rear substrate 100 and the first alignment pattern 102*a*. The dummy address electrode 101 can be formed when the plurality of address electrodes is formed on the display area 10 of the rear substrate 100. Here, the third alignment pattern 101 may be used rather than the first alignment pattern 102*a* when the yardstick pattern 26*a* is used to adjust the position of the front substrates 200 or the rear substrates 100.

In FIG. 5, the first alignment pattern 102*a* has a hexagonal shape. However, the invention is not limited to this. For example, the first alignment pattern 102*a* may have a quadrangular shape, as shown in FIG. 3*a*. Moreover, the first alignment pattern 102*a* may have a pentagonal shape, as shown in FIG. 3*b*. Furthermore, the first alignment pattern 102*a* may have a cross shape, as shown in FIG. 3*c*.

Figure 6:
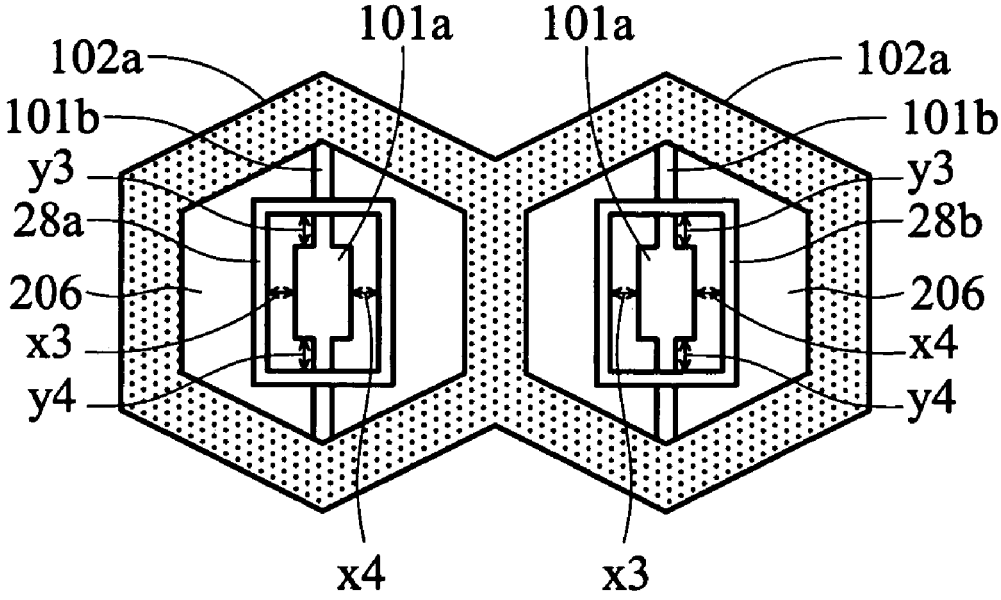
FIG. 6 is a plane view of further another example of an alignment structure for a plasma display panel according to the invention.

FIG. 6 is a plane view of further another example of an alignment structure for a plasma display panel according to the invention. Referring to FIGS. 1 and 6, the alignment structure includes a rear substrate 100, a first alignment pattern 101*b*, a front substrate 200, and a rectangular and ringed second alignment pattern 28*a*. In the invention, the first alignment pattern 101*b* is disposed on a rear substrate 100 and corresponds to the space defined by one of the hexagonal rib structures outside of the display area 10. For example, the first alignment pattern 101*b* may be a dummy address electrode having a rectangular block 101*a* formed on the non-display area 20 and between the rear substrate 100 and the hexagonal rib structure 102*a*. The dummy address electrode 101*b* can be formed when the plurality of address electrodes is formed on the display area 10 of the rear substrate 100.

The rectangular and ringed second alignment pattern 28*a* is disposed on a front substrate 200 disposed opposite, over the rear substrate 100. In the invention, the rectangular and ringed second alignment pattern 28*a* corresponds to a space around the rectangular block 101*a* and is separated therefrom by predetermined distances x3, x4, y3, and y4. Moreover, the second alignment pattern 28*a* may be formed when the plurality of bus electrodes lines 202 is formed overlying the front substrate 200. Moreover, the second alignment pattern 28*a* may be formed when the plurality of transparent electrodes 204 or the black matrix 205 is formed overlying the front substrate 200.

When alignment is performed between the front and rear substrates 200 and 100, the predetermined distances x3, x4, y3, and y4 may be measured for alignment of perpendicular and horizontal directions and for alignment interstitial control.

Additionally, the dielectric layer 206 overlying the front substrate 200 can be etched to form an opening 28*b* to serve as the second alignment pattern. The second alignment pattern 28*b* is rectangular and ringed and separated from the rectangular block 101*a* by predetermined distances x3, x4, y3, and y4. Also, the method mentioned can be used for aligning the front and rear substrates 200 and 100.

Figure 7:
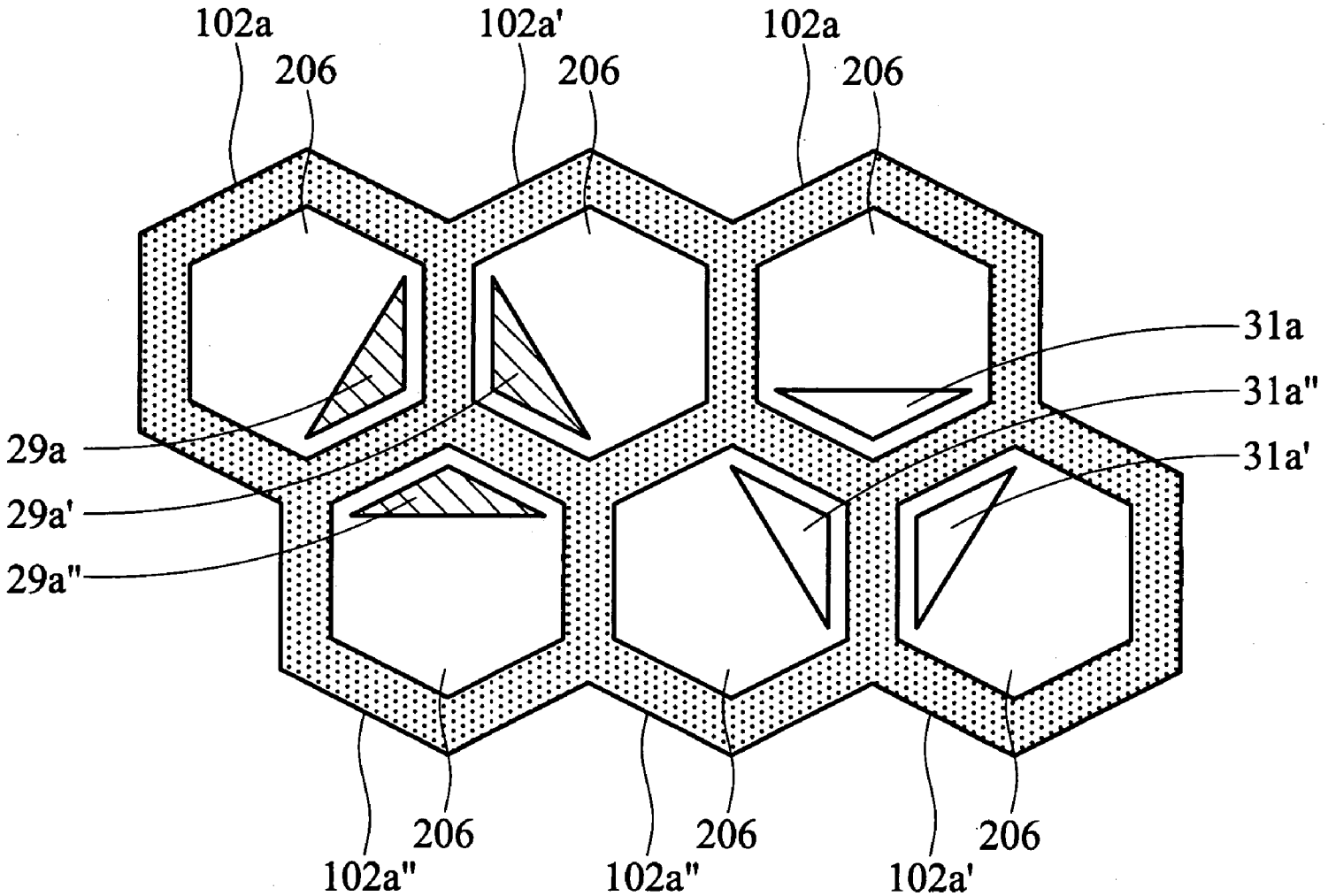
FIG. 7 is a plane view of still another example of an alignment structure for a plasma display panel according to the invention.

FIG. 7 is a plane view of still another example of an alignment structure for a plasma display panel according to the invention. Referring to FIGS. 1 and 7, the alignment structure includes a rear substrate 100, first, second, third, fourth, fifth, and sixth alignment patterns 102*a*, 29*a*, 102*a*', 29*a*', 102*a*", and 29", and a front substrate 200. In the invention, the first, third, and fifth alignment patterns 102*a*, 102*a*', and 102*a*" are disposed on the rear substrate 100 outside of the display area 10 (i.e. on the non-display area 20) and formed by three of the hexagonal rib structures adjacent to each other.

The second, fourth, and sixth alignment patterns 29*a*, 29*a*', and 29" are disposed on the front substrate 200 disposed opposite, over the rear substrate 100. In the invention, for example, the second, fourth, and sixth alignment patterns 29*a*, 29*a*', and 29" are three triangles respectively corresponding to each space defined by the first, third, and fifth alignment patterns 102*a*, 102*a*', and 102*a*". Moreover, each triangle 29*a*, 29*a*', or 29" is close to the corresponding hexagonal rib structures 102*a*, 102*a*', or 102*a*" to form slits between the first and second alignment patterns 102*a* and 29*a*, between the third and fourth alignment patterns 102*a*' and 29*a*', and between the fifth and sixth alignment patterns 102*a*" and 29*a*", respectively.

The second, fourth, and sixth alignment patterns 29*a*, 29*a*', and 29" may be formed when the plurality of bus electrodes lines 202 is formed overlying the front substrate 200. Moreover, the second, fourth, and sixth alignment patterns 29*a*, 29*a*', and 29" may be formed when the plurality of transparent electrodes 204 or the black matrix 205 is formed overlying the front substrate 200.

When alignment is performed between the front and rear substrates 200 and 100, these slits can be used for alignment interstitial control.

Additionally, the dielectric layer 206 overlying the front substrate 200 can be etched to form three triangular openings 31*a*, 31*a*', and 31*a*" respectively corresponding to each space defined by the three hexagonal rib structures 102*a*, 102*a*', and 102*a*" to serve as the second, fourth, six alignment patterns, respectively. As mentioned above, each triangular opening 31*a*, 31*a*', or 31" may be close to the corresponding hexagonal rib structures 102*a*, 102*a*', or 102*a*" to form slits. Also, the method mentioned can be used to align the front and rear substrates 200 and 100.

In FIG. 7, the first, third, and fifth alignment patterns 102*a*, 102*a*', or 102*a*" have a hexagonal shape. However, the invention is not limited to this. For example, they may have a quadrangular shape, as shown in FIG. 3*a*. Moreover, they may have a pentagonal shape, as shown in FIG. 3*b*. Furthermore, they may have a cross shape, as shown in FIG. 3*c*. Moreover, the second, fourth, and six alignment patterns 29*a*, 29*a*', and 29" or 31*a*, 31*a*', and 31" may have a suitable shape for the first, third, and fifth alignment patterns 102*a*, 102*a*', or 102*a*" with varied shapes.

Figure 8A:
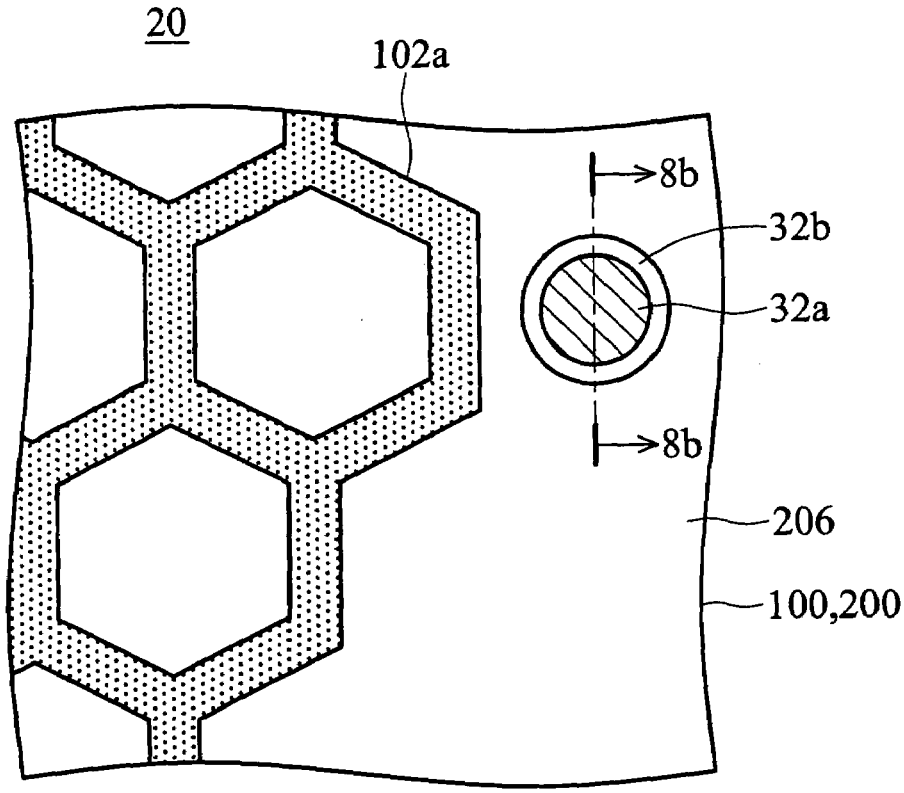
FIG. 8*a* is a plane view of even still another example of an alignment structure for a plasma display panel according to the invention.
Figure 8B:
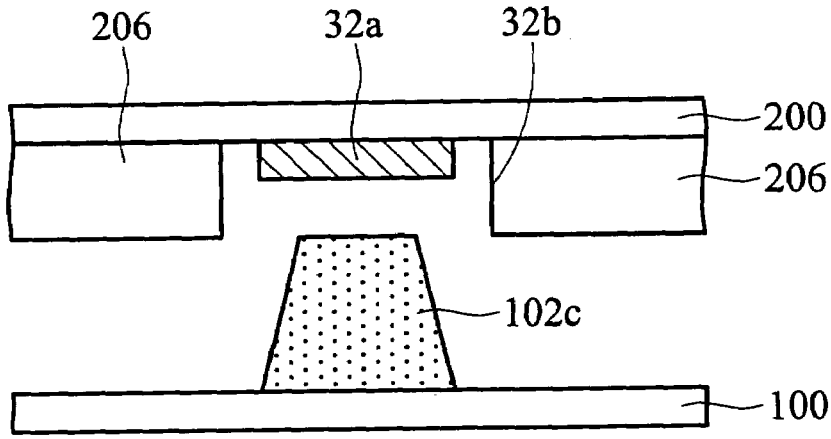
FIG. 8*b* is a cross-section along the line 8*b*-8*b* shown in FIG. 8*a*.

FIG. 8*a* is a plane view of even still another example of an alignment structure for a plasma display panel according to the invention and FIG. 8*b* is a cross-section along the line 8*b*-8*b* shown in FIG. 8*a*. The alignment structure includes a rear substrate 100, a columnar first alignment pattern 102*c*, a front substrate 200, a disklike second alignment pattern 32*a*, and a dielectric layer 206. The columnar first alignment pattern 102*c* is disposed on a rear substrate 200 outside of the display area 10 and formed by a rib. For example, the columnar rib 102*c* may be an alignment mark outside of the rib structures 102*a* on the non-display area 20 for phosphor alignment. The columnar rib 102*c* may be formed when the rib structures 102*a* are formed.

The disklike second alignment pattern 32*a* is disposed on the front substrate 200 disposed opposite, over the rear substrate 100. In the invention, the disklike second alignment pattern 32*a* corresponds to the columnar first alignment pattern 102*c*. Moreover, the disklike second alignment pattern 32*a* may be formed when the plurality of bus electrodes lines 202 is formed overlying the front substrate 200. Moreover, the disklike second alignment pattern 32*a* may be formed when the plurality of transparent electrodes 204 or the black matrix 205 is formed overlying the front substrate 200.

The dielectric layer 206 overlies the front substrate 200 and the disklike second alignment pattern 32*a*.

When alignment is performed between the front and rear substrates 200 and 100, the concentric circle method can be used by the columnar rib 102*c* and the overlying disklike second alignment pattern 32*a* for alignment of the front and rear substrates 200 and 100.

Additionally, the dielectric layer 206 may have an opening 32*b* to expose the disklike second alignment pattern 32*a*. The underlying columnar rib 102*c* can be inserted into the opening 32*b* for aligning the front and rear substrates 200 and 100.

Figure 9:
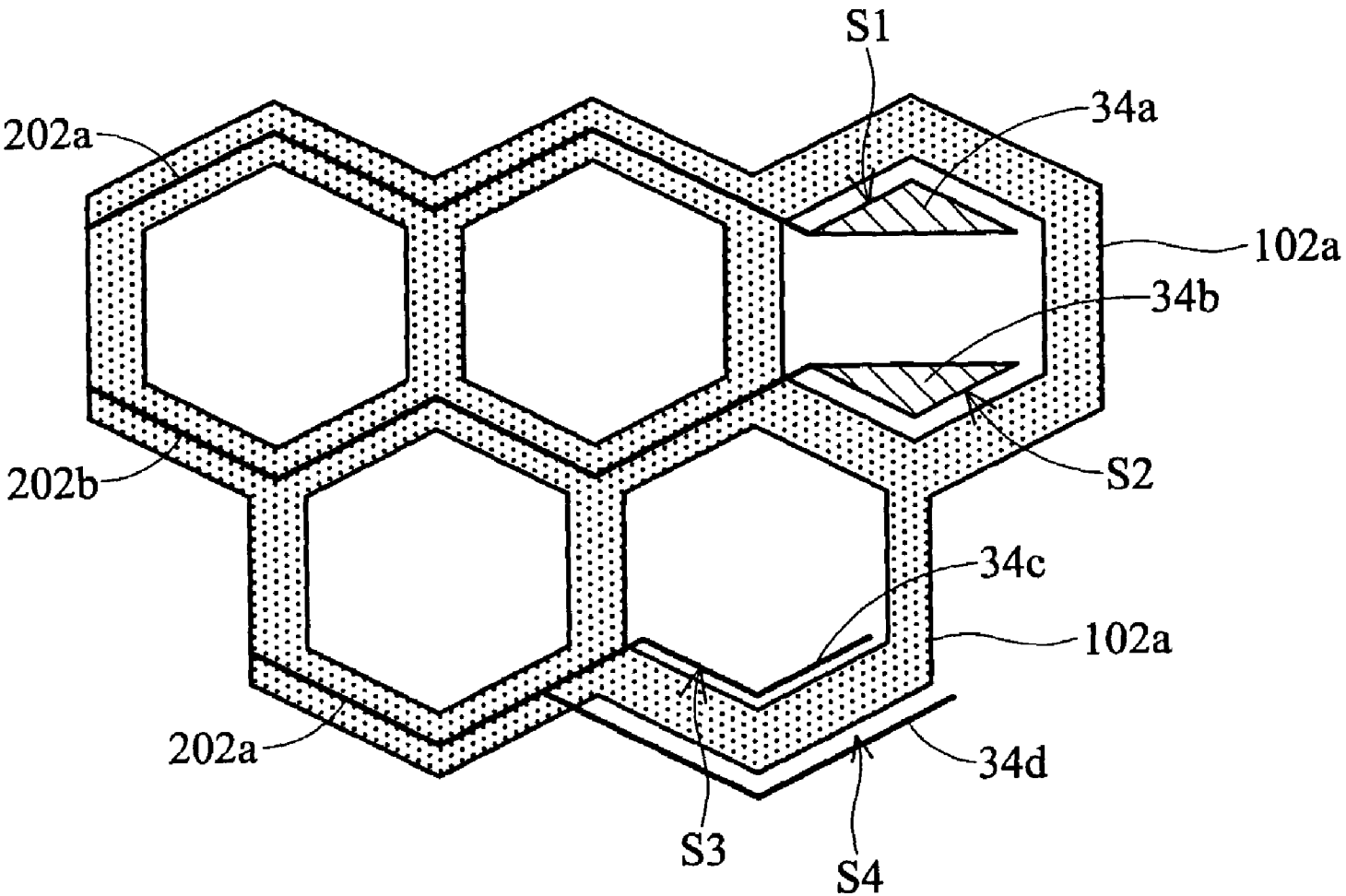
FIG. 9 is a plane view of another, final example of an alignment structure for a plasma display panel according to the invention.

FIG. 9 is a plane view of another, final example of an alignment structure for a plasma display panel according to the invention. Referring to FIGS. 1 and 9, the alignment structure includes a rear substrate 100, a first alignment pattern 102*a*, a front substrate 200, a second alignment pattern 34*a*, and a third alignment pattern 34*b*. In the invention, one of the alignment patterns is disposed on the rear substrate 100 outside of the display area 10 and formed by at least one hexagonal rib structure. That is, at least one of the hexagonal rib structures 102*a* on the non-display area 20 may be used as the first alignment pattern.

The second alignment pattern 34*a* is disposed on the front substrate 200 disposed opposite, over the rear substrate 100. For example, the second alignment pattern 34*a* may be a triangle extending from the end of a bus electrode 202*a* which extends from the bus electrode 202 on the display area 10. That is, the second alignment pattern 34*a* may comprise the same material as the bus electrode 202*a*. Moreover, the second alignment pattern 34*a* corresponds to a space defined by the first alignment pattern 102*a*, wherein the second alignment pattern 34*a* is close to the first alignment pattern 102*a* to form a slit S1 therebetween.

The third alignment pattern 34*b* is disposed on the front substrate 200. For example, the third alignment pattern 34*b* may be a triangle extending from the end of another bus electrode 202*b* symmetrical to the bus electrode 202*a* and corresponding to the space defined by the first alignment pattern 102*a*. In the invention, the third alignment pattern 34*b* may comprise the same material as the bus electrode 202*b*. Moreover, the third alignment pattern 34*b* is close to the first alignment pattern 102*a* to form a slit S2 therebetween.

When alignment is performed between the front and rear substrates 200 and 100, the slits S1 and S2 can be used for alignment interstitial control.

Additionally, the second alignment pattern may be a line 34*c* extending from the end of the bus electrode 202*a*, which comprises the same material as the bus electrode 202*a*. Moreover, the second alignment pattern 34*c* corresponds to the space defined by the first alignment pattern 102*a*, wherein the line 34*c* is close to the first alignment pattern 102*a* to form a slit S3 therebetween. Moreover, a line 34*d* extending from the bus electrode 202*a*, which comprises the same material as the bus electrode 202*a*, is used as the third alignment pattern. In the invention, the third alignment pattern 34*d* corresponds to a space outside of the first alignment pattern 102*a* and forms a slit S4 therebetween.

Also, when alignment is performed between the front and rear substrates 200 and 100, the slits S3 and S4 can be used for alignment interstitial control.

Figure 10A:
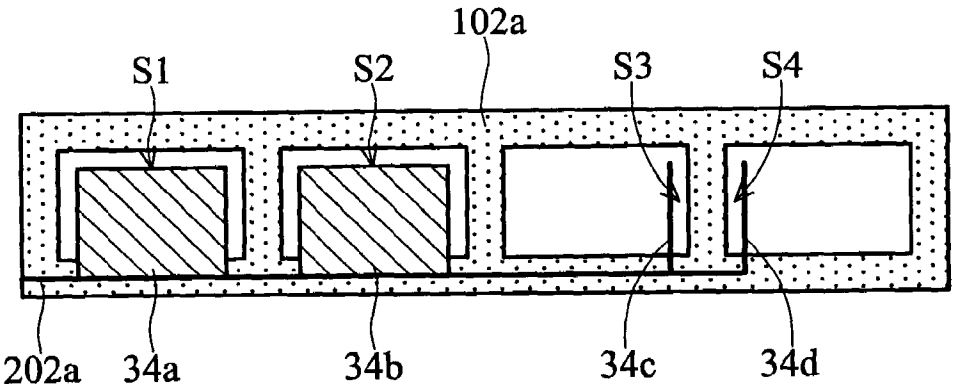
FIGS. 10*a* to 10*c* illustrate varied examples according to FIG. 9.
Figure 10B:
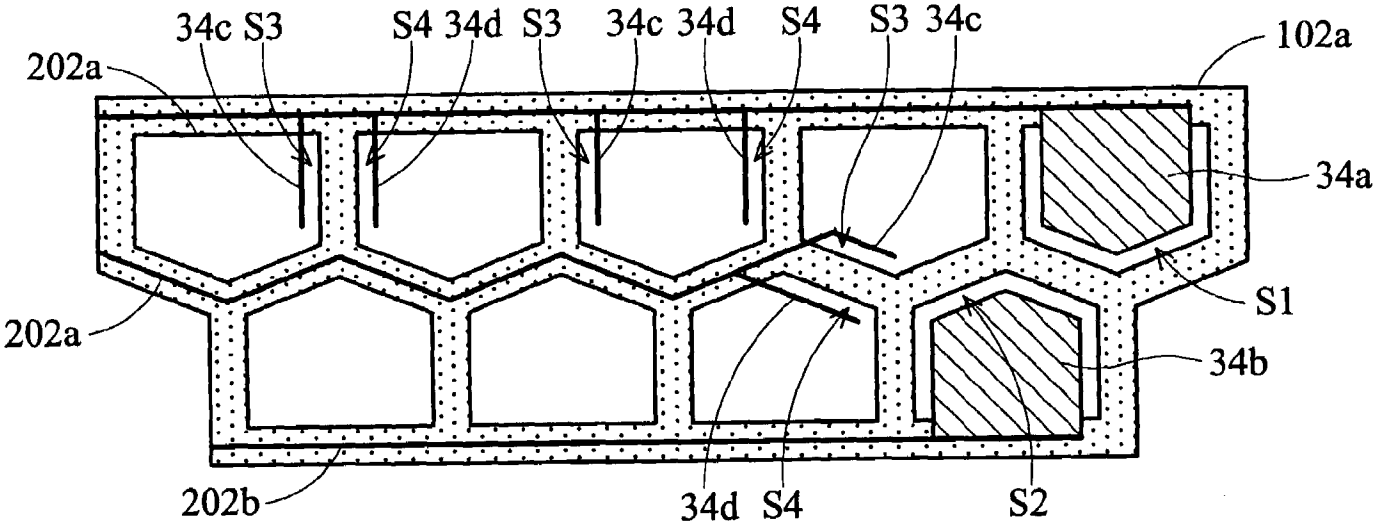
Figure 10C:
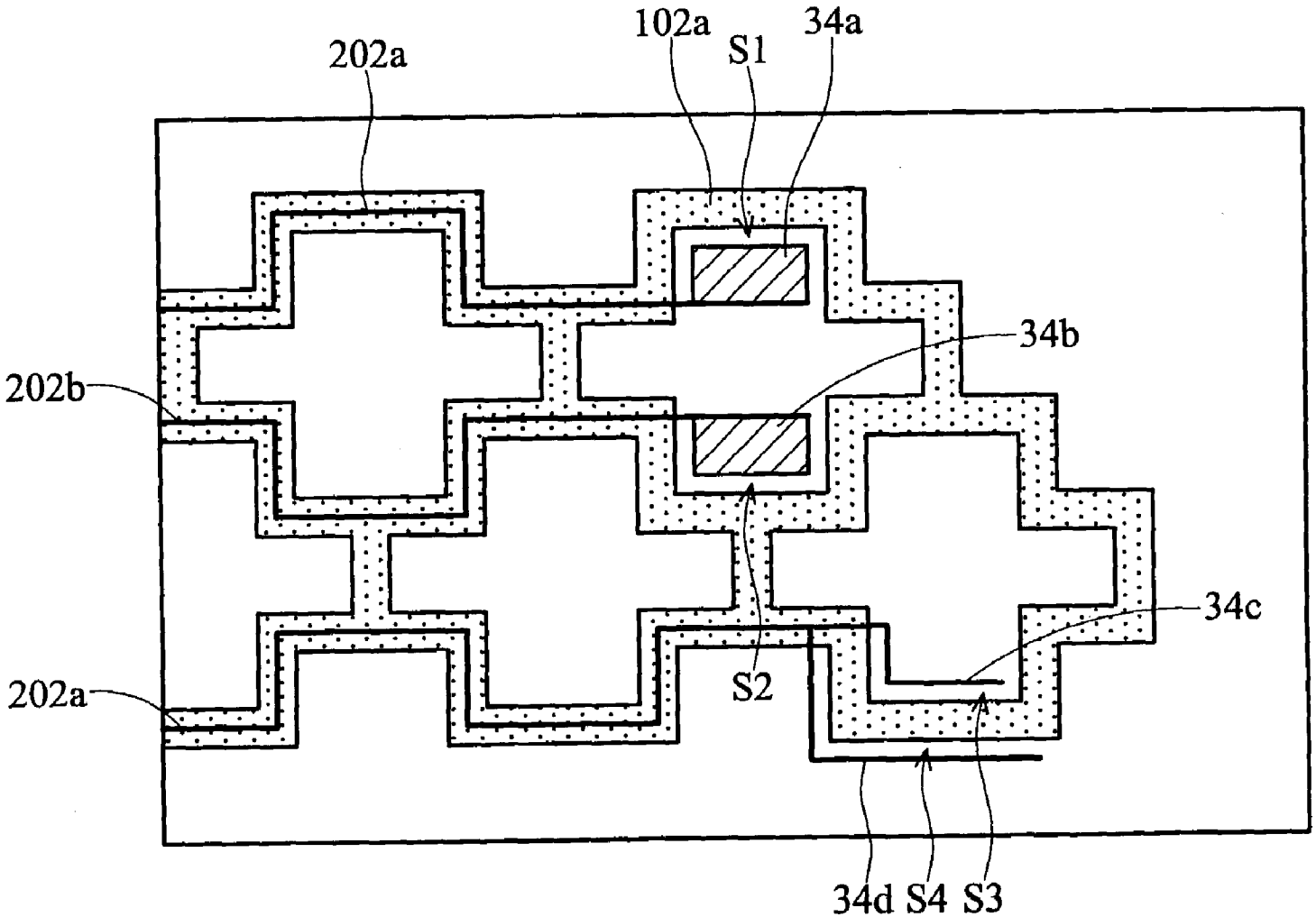
Figure 11:
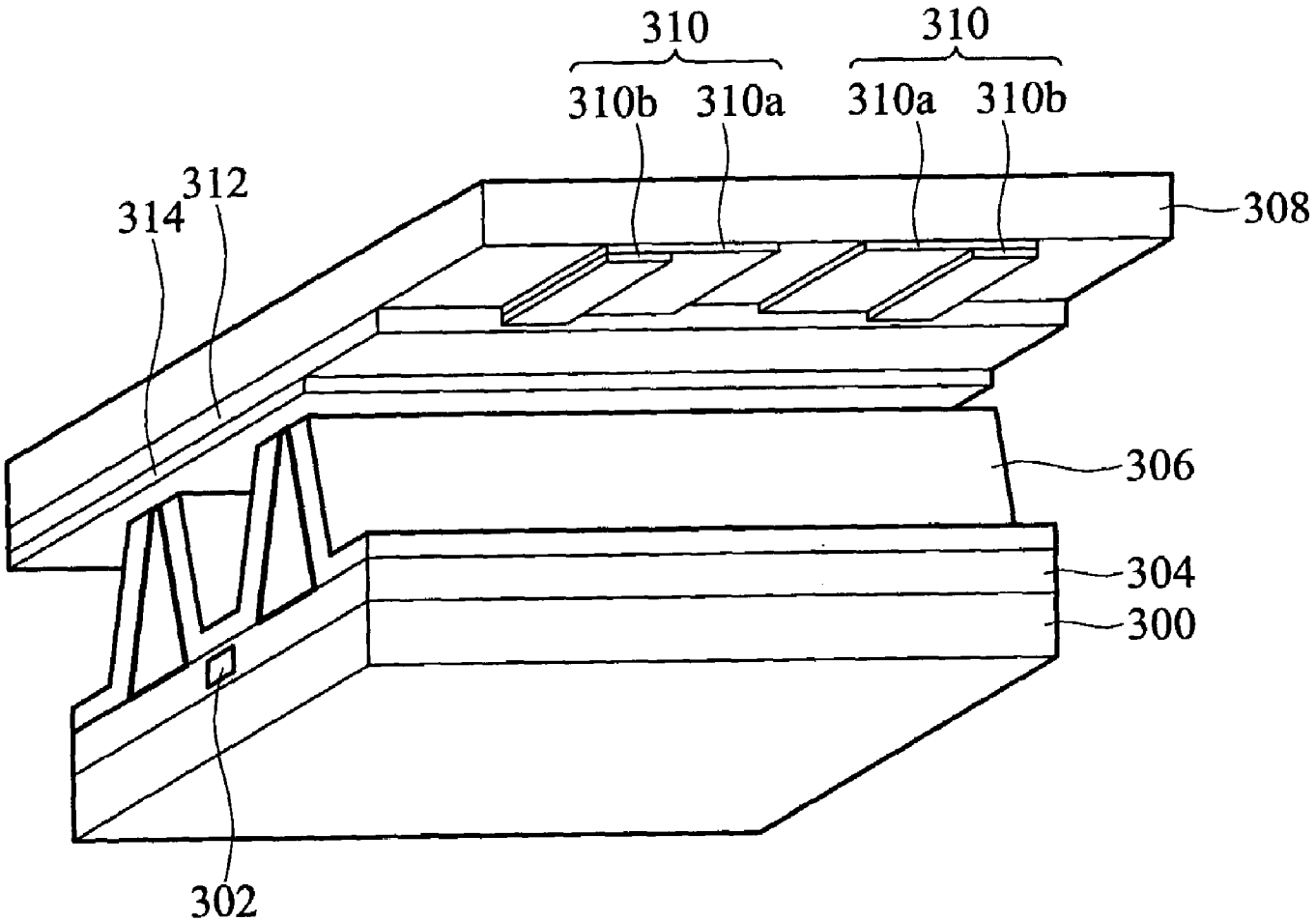
FIG. 11 (RELATED ART)
FIG. 11 illustrates a conventional plasma display panel structure.

FIGS. 10*a* to 10*c* illustrate varied examples according to FIG. 9. Like or analogical elements in FIG. 9 and FIGS. 10*a* to 10*c* are denoted by like numbers and the description to refer to the same or like parts is omitted.

In FIG. 10*a*, the first alignment pattern 102*a* has a quadrangular shape. Moreover, the second and third alignment patterns have quadrangular shape 34*a* and 34*b* or linear shape 34*c* and 34*d*. However, the invention is not limited to this. For example, they may have a triangular shape. It is noted that the third alignment pattern 34*b* or 34*d* may correspond to another space outside of the space where the second alignment pattern 34*a* or 34*c* is disposed therein, as shown in FIG. 10*a*. Additionally, the third alignment patterns 34*b* or 34*d* may correspond to the space where the second alignment pattern 34*a* or 34*c* is disposed therein.

In FIG. 10*b*, the first alignment pattern 102*a* has a pentagonal shape. Moreover, the second and third alignment patterns have pentagonal shape 34*a* and 34*b* or linear shape 34*c* and 34*d*. However, the invention is not limited to this. For example, they may have a triangular shape. It is noted that the third alignment pattern 34*b* extending from the end of the bus electrode 202*b* symmetrical to the bus electrode 202*a* may correspond to another space outside of the space where the second alignment pattern 34*a* is disposed therein, as shown in FIG. 10*b* Additionally, the third alignment patterns 34*b* may correspond to the space where the second alignment pattern 34*a* is disposed therein. Also, the third alignment pattern 34*d* may correspond to another space outside of the space where the second alignment pattern 34*c* is disposed therein or correspond to the space where the second alignment pattern 34*c* is disposed therein.

In FIG. 10*c*, the first alignment pattern 102*a* has a cross shape. Moreover, the second and third alignment patterns have quadrangular shape 34*a* and 34*b* or linear shape 34*c* and 34*d*. However, the invention is not limited to this. For example, they may have a triangular shape.

According to the invention, at least one rib structure or address electrode formed on the rear substrate and positioned outside of the display area is used as an alignment pattern, such that there is no need for additional alignment marks on the rear substrate. Moreover, the alignment mark formed by rib structure can prevent deformation from repeated thermal processes prior to formation of the discharge cells by rib structures. Accordingly, alignment errors between the rear and front substrates of the PDP are reduced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An alignment structure for a plasma display panel, the alignment structure disposed outside of the display area of the plasma display panel, comprising:

a rear substrate;

a first alignment pattern disposed on the rear substrate outside of the display area, comprised of a rib structure extending from the display area;

a front substrate disposed opposite, over the rear substrate;

a second alignment pattern disposed on the front substrate outside of the display area and corresponding to a space defined by the first alignment pattern;

wherein the second alignment pattern comprises the same material as a bus electrode, a transparent electrode, a black matrix, or a dielectric layer overlapped the front substrate.

2. The alignment structure as claimed in claim 1, wherein the first alignment pattern is quadrangular, pentagonal, hexagonal, or cross-shaped.

3. The alignment structure as claimed in claim 1, wherein the second alignment pattern has a profile similar to that of the first alignment pattern.

4. The alignment structure as claimed in claim 1, wherein the second alignment pattern has a circular profile.

5. The alignment structure as claimed in claim 4, wherein the second alignment pattern is ringed.

6. The alignment structure as claimed in claim 5, further comprising a columnar rib disposed on the rear substrate outside of the display area and corresponding to a second space defined by the second alignment pattern.

7. The alignment structure as claimed in claim 1, wherein the second alignment pattern acts as a yardstick.

8. The alignment structure as claimed in claim 7, further comprising a third alignment pattern comprising an address electrode disposed between the rear substrate and the first alignment pattern out side of the display area and corresponding to the space defined by the first alignment pattern.

9. The alignment structure as claimed in claim 1, further comprising:

a third alignment pattern disposed on the rear substrate outside of the display area comprising a second rib structure adjacent to the first alignment pattern; and a fourth alignment pattern disposed on the front substrate outside of the display area and corresponding to a second space defined by the third alignment pattern;

wherein the second alignment pattern is close to the first alignment pattern, to form a first slit therebetween and the fourth alignment pattern is close to the third alignment pattern, to form a second slit therebetween.

10. The alignment structure as claimed in claim 9, further comprising:

a fifth alignment pattern disposed on the rear substrate outside of the display area comprising a third rib structure adjacent to the first-and third alignment patterns; and a sixth alignment pattern disposed on the front substrate outside of the display area and corresponding to a third space defined by the fifth alignment pattern;

wherein the sixth alignment pattern is close to the fifth alignment pattern, to form a third slit therebetween.

11. An alignment structure for a plasma display panel, the alignment structure disposed outside of the display area of the plasma display panel, comprising:

a rear substrate;

a first alignment pattern disposed on the rear substrate outside of the display area comprising an address electrode having a rectangular block;

a front substrate disposed opposite, over the rear substrate; and a rectangular and ringed second alignment pattern disposed on the front substrate outside of the display area and corresponding to a space around the rectangular block.

12. The alignment structure as claimed in claim 11, wherein the second alignment pattern comprises the same material as a bus electrode overlying the front substrate.

13. The alignment structure as claimed in claim 11, wherein the second alignment pattern comprises the same material as a transparent electrode overlying the front substrate.

14. The alignment structure as claimed in claim 11, wherein the second alignment pattern comprises the same material as a black matrix overlying the front substrate.

15. The alignment structure as claimed in claim 11, wherein the second alignment pattern comprises the same material as a dielectric layer overlying the front substrate.

16. An alignment structure for a plasma display panel, the alignment structure disposed outside of the display area of the plasma display panel, comprising:

a rear substrate;

a columnar first alignment pattern disposed on the rear substrate outside of the display area and formed by a rib;

a front substrate disposed opposite, over the rear substrate;

a disklike second alignment pattern disposed outside of the display area on the front substrate and corresponding to the columnar first alignment pattern; and a dielectric layer overlying the front substrate, comprising an opening exposing the disklike second alignment pattern.

17. The alignment structure as claimed in claim 16, wherein the second alignment pattern comprises the same material as a bus electrode overlying the front substrate.

18. The alignment structure as claimed in claim 16, wherein the second alignment pattern comprises the same material as a transparent electrode overlying the front substrate.

19. The alignment structure as claimed in claim 16, wherein the second alignment pattern comprises the same material as a black matrix overlying the front substrate.

20. An alignment structure for a plasma display panel, the alignment structure disposed outside of the display area of the plasma display panel, comprising:

a rear substrate;

a first alignment pattern disposed on the rear substrate outside of the display area comprising a rib structure;

a front substrate disposed opposite, over the rear substrate; and a second alignment pattern disposed on the front substrate outside of the display area, extending from the end of a bus electrode and corresponding to a space defined by the first alignment pattern.

21. The alignment structure as claimed in claim 20, wherein the second alignment pattern is close to the first alignment pattern, to form a first slit therebetween.

22. The alignment structure as claimed in claim 20, further comprising a third alignment pattern disposed on the front substrate outside of the display area, extending from the end of a second bus electrode symmetrical to the bus electrode and corresponding to the space defined by the first alignment pattern or a second space outside of the first alignment pattern.

23. The alignment structure as claimed in claim 22, wherein the third alignment pattern is close to the first alignment pattern, to form a second slit therebetween and comprises the same material as the second bus electrode.

24. The alignment structure as claimed in claim 20, further comprising a third alignment pattern disposed on the front substrate outside of the display area, extending from the bus electrode and corresponding to the spaced defined by the first alignment pattern or a second space outside of the first alignment pattern.

25. The alignment structure as claimed in claim 24, wherein the third alignment pattern is close to the first alignment pattern, to form a second slit therebetween and comprises the same material as the second bus electrode.

26. The alignment structure as claimed in claim 20, wherein the first alignment pattern is quadrangular, pentagonal, hexagonal, or cross-shaped.

27. An alignment structure for a plasma display panel, the alignment structure disposed outside of the display area of the plasma display panel, comprising:

a rear substrate;

a columnar first alignment pattern disposed on the rear substrate outside of the display area and formed by a rib;

a front substrate disposed opposite, over the rear substrate; and a disklike second alignment pattern disposed outside of the display area on the front substrate and corresponding to the columnar first alignment pattern;

wherein the second alignment pattern comprises the same material as a bus electrode overlying the front substrate.

28. The alignment structure as claimed in claim 27, further comprising a dielectric layer overlying the front substrate and the disklike second alignment pattern.

* * * * *